US007023384B2

(12) United States Patent
Brown et al.

(10) Patent No.: US 7,023,384 B2
(45) Date of Patent: Apr. 4, 2006

(54) BEAM STEERING WITH A PERIODIC RESONANCE STRUCTURE

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 227 days.

(21) Appl. No.: 10/637,409

(22) Filed: Aug. 8, 2003

(65) Prior Publication Data

US 2005/0030238 A1 Feb. 10, 2005

(51) Int. Cl.
*H01Q 1/38* (2006.01)

(52) U.S. Cl. ..... 343/700 MS; 343/789; 324/338

(58) Field of Classification Search ..... 343/700 MS, 343/719, 789, 909, 912; 342/372; 324/338
See application file for complete search history.

(56) References Cited

U.S. PATENT DOCUMENTS

| | | | | | |
|---|---|---|---|---|---|
| 3,231,892 | A | | 1/1966 | Matson et al. | 343/775 |
| 4,651,100 | A | * | 3/1987 | Janes | 324/338 |
| 4,678,997 | A | * | 7/1987 | Janes | 324/341 |
| 4,684,952 | A | | 8/1987 | Munson et al. | 343/700 MS |
| 5,162,972 | A | | 11/1992 | Gripshover et al. | 174/256 |
| 6,515,235 | B1 | | 2/2003 | Moller | 361/277 |
| 2004/0155817 | A1 | * | 8/2004 | Kingsley et al. | 343/700 MS |

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.

(Continued)

*Primary Examiner*—Don Wong
*Assistant Examiner*—Jimmy Vu
(74) *Attorney, Agent, or Firm*—Sacco & Associates, PA

(57) ABSTRACT

Method and apparatus for steering an antenna beam using a periodic resonance structure (300). The method can include the step of electrically and magnetically coupling a first fluid dielectric (114) to a plurality of transmission line stubs (104) that are respectively coupled to a plurality of radiating elements (102) of a periodic resonance structure (300). The first fluid dielectric (114) is controlled to selectively vary an electrical length of each of the transmission line stubs (104). This permits directing an angle of a redirected RF beam produced by an incident RF signal (306) impinging on the periodic resonance structure (300).

16 Claims, 3 Drawing Sheets

OTHER PUBLICATIONS

U.S. Appl. No. 10/632,632, filed Aug. 1, 2003, Rawnick et al.
U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/300,455, filed Nov. 19, 2002, Brown et al.
U.S. Appl. No. 10/640,237, filed Aug. 13, 2003, Rawnick et al.
U.S. Appl. No. 10/640,148, filed Aug. 13, 2003, Brown et al.

* cited by examiner

BEAM STEERING WITH A PERIODIC RESONANCE STRUCTURE

BACKGROUND OF THE INVENTION

1. Statement of the Technical Field

The inventive arrangements relate generally to methods and apparatus for steerable beam antennas, and more particularly to periodic resonance structures that can be used for steering antenna beams.

2. Description of the Related Art

Periodic resonance structures may be found in a wide variety of RF applications. One example of a periodic resonance structure is a frequency selective surface (FSS). An FSS is conventionally designed to either block or pass electromagnetic waves at a selected frequency. These types of surfaces are essentially periodic resonance structures that are comprised of a conducting sheet periodically perforated with closely spaced apertures, or may be comprised of an array of periodic metallic patches. FSS structures can generally be separated into two broad categories, namely inductive and capacitive type geometries. An inductive FSS operates in a manner similar to a band-pass filter. A capacitive FSS, behaves in a manner that is similar to a band-stop filter. When the periodic elements comprising an inductive FSS are at resonance, the FSS will pass RF signals that are at or near the resonant frequency. In contrast, the capacitive FSS will reflect signals at or near the resonant frequency of the elements.

A typical capacitive FSS is constructed out of periodic rectangular metal patches disposed on a planar substrate. By comparison, an inductive type FSS is typically constructed using periodic rectangular apertures which are formed by perforating a metal sheet that has been deposited on a substrate. Many other types of FSS element configurations are known, including circles, Jerusalem crosses, concentric rings, mesh-patch arrays or double squares supported by a dielectric substrate. Depending upon the geometry selected, these can combine features of inductive and capacitive elements and can beg used to provide desirable frequency responses. U.S. Pat. No. 3,231,892 describes some basic FSS geometries and one potential application for an FSS type periodic resonance structure. Notably, signals that are blocked by a FSS are typically reflected away from the FSS, but the reflected direction is often not a matter of concern for the designer.

Another type of periodic resonance structure is a reflectarray. A reflectarray is typically comprised of an array of resonantly-dimensioned microstrip antenna radiator patches that are closely spaced above a ground plane. Conventional electronic phase shifters can be provided for shifting the phase of an incident RF signal received by each antenna radiator patch and then retransmitting the signal, usually via the same antenna radiator patch. For example, diode switches can be used to control a transmission line structure to vary a phase shift. The phase shifts of the individual resonators create a phased array effect that can be controlled to determine the direction of a redirected beam of RF energy. One example of a reflectarray is disclosed in U.S. Pat. No. 4,684,952 to Munson et al. However, alternative arrangements are also known in the art.

SUMMARY OF THE INVENTION

The invention concerns a method for steering an antenna beam using a periodic resonance structure. The method can include the step of electrically and magnetically coupling a first fluid dielectric to a plurality of transmission line stubs that are respectively coupled to a plurality of radiating elements of a periodic resonance structure. The first fluid dielectric is controlled to selectively vary an electrical length of each of the transmission line stubs. This permits directing an angle of a redirected RF beam produced by an incident RF signal impinging on the periodic resonance structure.

According to one aspect of the invention, the controlling step can include varying a volume of the first fluid dielectric coupled to the transmission line stubs to control an electrical length of the plurality of transmission line stubs. Selectively varying the volume can include the steps of pumping a fluid dielectric into and out of a cavity structure positioned adjacent to the transmission line stub. In particular, independently varying the volume of the first fluid dielectric can be used to control the beam angle of the redirected RF beam.

When the volume of the first fluid dielectric is varied, it can displace a gas contained in said cavity structure or a second fluid dielectric also contained within the cavity structure. If a second fluid dielectric is displaced, then the first and second fluid dielectrics can be selected to be immiscible.

According to another aspect of the invention, the step of selectively controlling the fluid dielectric can be performed by increasing or decreasing a volume of the fluid dielectric contained in the plurality of cavity structures. Since the cavity structures are respectively coupled to the plurality of transmission line stubs, the variation in the fluid volume can be used to vary an electrical length of the plurality of transmission line stubs.

According to another aspect, the invention can also include a steerable beam antenna that operates in accordance with the above-described method. More particularly, a periodic resonance structure can include a plurality of transmission line stubs respectively coupled to a plurality of radiating elements. A plurality of cavity structures, each capable of containing fluid dielectric, can be provided proximate to the stubs so that the fluid dielectric is electrically and magnetically coupled to the transmission line stubs. At least one fluid processor can be provided for controlling the fluid dielectric. More particularly, the fluid processor can control the fluid dielectric to selectively vary an electrical length of the transmission line stubs. In so doing, an angle of a redirected RF beam produced by an incident RF signal impinging on the periodic resonance structure can be controlled to direct an antenna beam produced by the periodic resonance structure.

The fluid processor can comprises a controller and at least one pump for controlling a volume of the first fluid dielectric contained in the cavity structures so as to vary an electrical length of the transmission line stubs. The first fluid dielectric displaces a gas or a second fluid dielectric contained in said cavity structure. However, if a second fluid dielectric is used, the first and second fluid dielectrics can be immiscible so that an immiscible fluid interface separates the first and second fluid dielectrics.

According to another aspect, the fluid processor can be configured to control the fluid dielectric by selectively increasing and decreasing a volume of fluid dielectric contained in the plurality of cavity structures respectively coupled to the transmission line stubs.

DETAILED DESCRIPTION OF THE PREFERRED EMBODIMENTS

Figure 1:
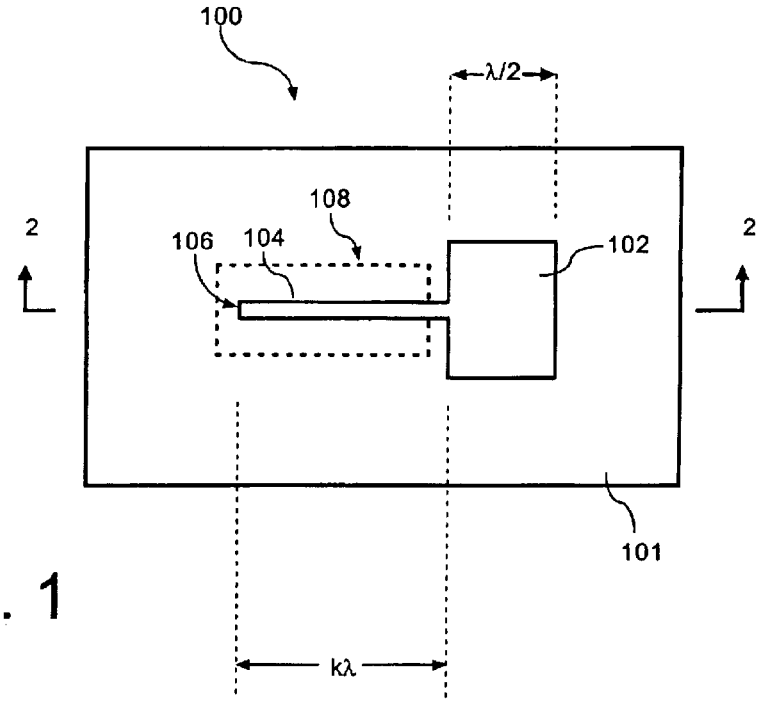
FIG. 1 is a top view of a single element of a periodic resonance structure type antenna that can be controlled with a fluid dielectric.
Figure 2:
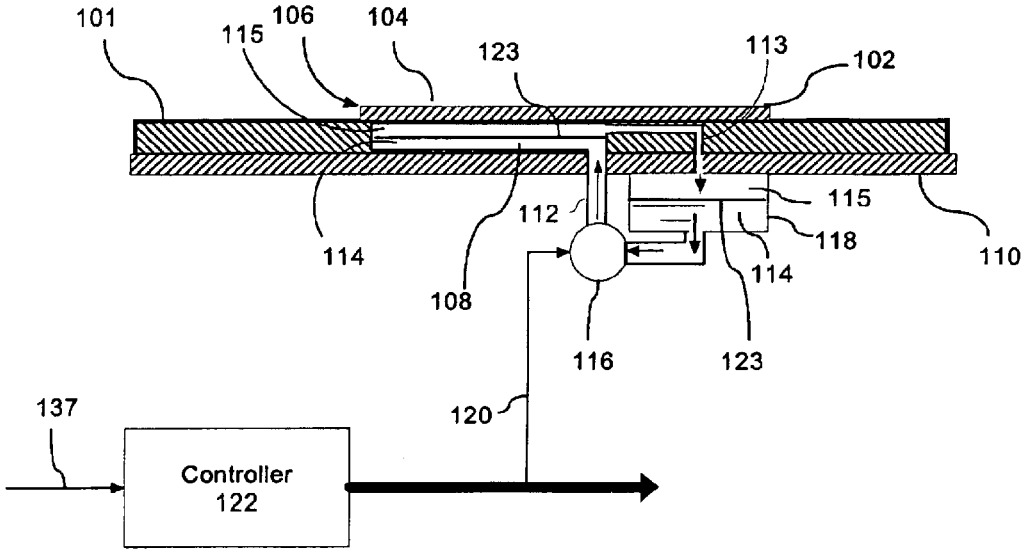
FIG. 2 is a cross-sectional view of the element of FIG. 1.

FIGS. 1 and 2 illustrate a single element 100 which can be used to form a steered beam periodic resonance structure. FIG. 1 is a top view of the element 100 and FIG. 2 is a cross-sectional view of the element 100 taken along line 2—2 in FIG. 1. The element 100 in FIG. 1 is comprised of a radiating element 102 closely spaced above an electrically conducting ground plane 110. In the exemplary embodiment of FIGS. 1 and 2, the radiating element 102 is a conventional patch antenna and can have a resonant dimension of one half wavelength. According to a preferred embodiment, the radiating element 102 can be disposed on a dielectric substrate 101. The dielectric substrate can be any suitable material but is preferably a glass/ceramic substrate for reasons that shall subsequently discussed in more detail.

Radiating element 102 as illustrated in FIGS. 1 and 2 are well known in the art. However, it should be understood that the particular type of radiating element illustrated is not essential to the invention and a variety of other types of radiating elements can also be used. For example, other shapes including square, rectangular, circular, and elliptical designs can also be used.

Referring again to FIGS. 1 and 2, it can be seen that the element 100 includes an integrally formed microstrip transmission line stub 104. The transmission line stub is also preferably formed on the dielectric substrate 101 and is preferably coupled to an impedance matched feed point associated with radiating element 102. The transmission line stub can be terminated as an open circuit or a short circuit termination at 106. In FIGS. 1 and 2, an open circuit termination is shown. It should be noted that while a microstrip type transmission line is shown in FIGS. 1 and 2, the invention is not so limited. Any convenient type of transmission line stub can be used for this purpose. For example, the transmission line stub can also be fabricated in a buried microstrip or stripline configuration.

RF radiation incident on the element 100 will be coupled to the radiating element 102 and will be converted to corresponding RF electrical currents which propagate along the microstrip transmission line stub 104, toward termination 106. Provided that termination 106 is an open circuit or a short circuit, the RF currents propagating along the transmission line stub 104 toward termination 106 will be reflected back toward the radiating element 102 and re-radiated from the element. Those skilled in the art will readily appreciate that the electrical length of the transmission line stub 104 will introduce a phase shift in the re-radiated signal. The amount of the phase shift will be a function of the transmission line stub length and the type of termination.

A cavity structure 108 can be disposed below the transmission line stub 104. The cavity structure 108 preferably includes a port 112 so that a fluid dielectric 114 may be circulated or moved into and out of the cavity structure 108. The cavity structure can extend partly or completely between the conductive ground plane 110 and the transmission line stub 104.

Notably, the transmission line stub 104 has a physical length and an electrical length. The electrical length k (where k is preferably some fraction of a wavelength $\lambda$) will be determined by the physical length $k\lambda$ of the transmission line stub 104 and the electrical characteristics of the dielectric material below the line. Since the dielectric material below the line is fluid dielectric 114, the electrical length of the line will depend upon the electrical characteristics of the fluid dielectric at every point below the transmission line stub 104. By selectively controlling the fluid dielectric 114, the electrical length (and the resulting phase shift) can be varied.

Two important characteristics of dielectric materials are permittivity (sometimes called the relative permittivity or $\epsilon_r$) and permeability (sometimes referred to as relative permeability or $\mu_r$). The permittivity and permeability determine the propagation velocity of a signal, which is approximately inversely proportional to $\sqrt{\mu\epsilon}$. The propagation velocity directly affects the electrical length of a transmission line and therefore the amount of phase shift introduced to signals that traverse the line.

Further, ignoring loss, the characteristic impedance of a transmission line, such as stripline or microstrip, is equal to $\sqrt{L_l/C_l}$ where $L_l$ is the inductance per unit length and $C_l$ is the capacitance per unit length. The values of $L_l$ and $C_l$ are generally determined by the permittivity and the permeability of the dielectric material(s) used to separate the transmission line structures as well as the physical geometry and spacing of the line structures. If permittivity and permeability are maintained in a constant ratio, then the characteristic impedance of the line will remain the same, while the electrical length of the line will be changed.

According to one embodiment, the fluid dielectric 114 can be selectively controlled by controlling the volume of the fluid dielectric that is contained within cavity structure 108. As shown in FIG. 2, the volume of the fluid dielectric 114 contained in cavity structure 108 can be increased or decreased by means of a pump 116 in fluid communication with the cavity structure 108 and a reservoir 118. The pump 116 can be a conventional pump or a micro electromechanical device which can optionally be integrated into the dielectric substrate 101. Similarly, reservoir 118 can be external to the dielectric substrate 101 or can be formed integral therewith. The pump 116 is preferably operable independently in response to a pump control signal 120 from a central control unit 122.

According to one embodiment, the portion 115 of cavity structure 108 and reservoir 118 not occupied by fluid dielectric 114 can be occupied by an inert gas. Vent tube 113 allows displacement of any of the inert gas contained within the cavity structure 108. If the relative permeability or permittivity of the fluid dielectric is selected to be different as compared to the inert gas, then increasing or decreasing the amount of fluid dielectric 114 contained within the cavity structure 108 will vary the electrical length of the transmission line stub 104. In turn, this will selectively vary a phase shift of RF energy communicated on stub 104.

According to an alternative embodiment, the portion 115 of the cavity structure and reservoir 118 not occupied by the fluid dielectric 114 can be occupied by a second fluid dielectric with electrical properties different as compared to fluid dielectric 114. In that case, the second fluid dielectric can be selected to be immiscible with the first fluid dielectric so as to define an immiscible fluid interface 123. An example of immiscible fluids would include oil and water.

According to a preferred embodiment, the relative permittivity and permeability of the fluid dielectric are preferably selected so that the introduction of such fluid dielectric into the cavity 108 does not alter the characteristic impedance of the transmission line stub. This can be accomplished by always maintaining a constant ratio of relative permittivity to relative permeability.

Figure 3:
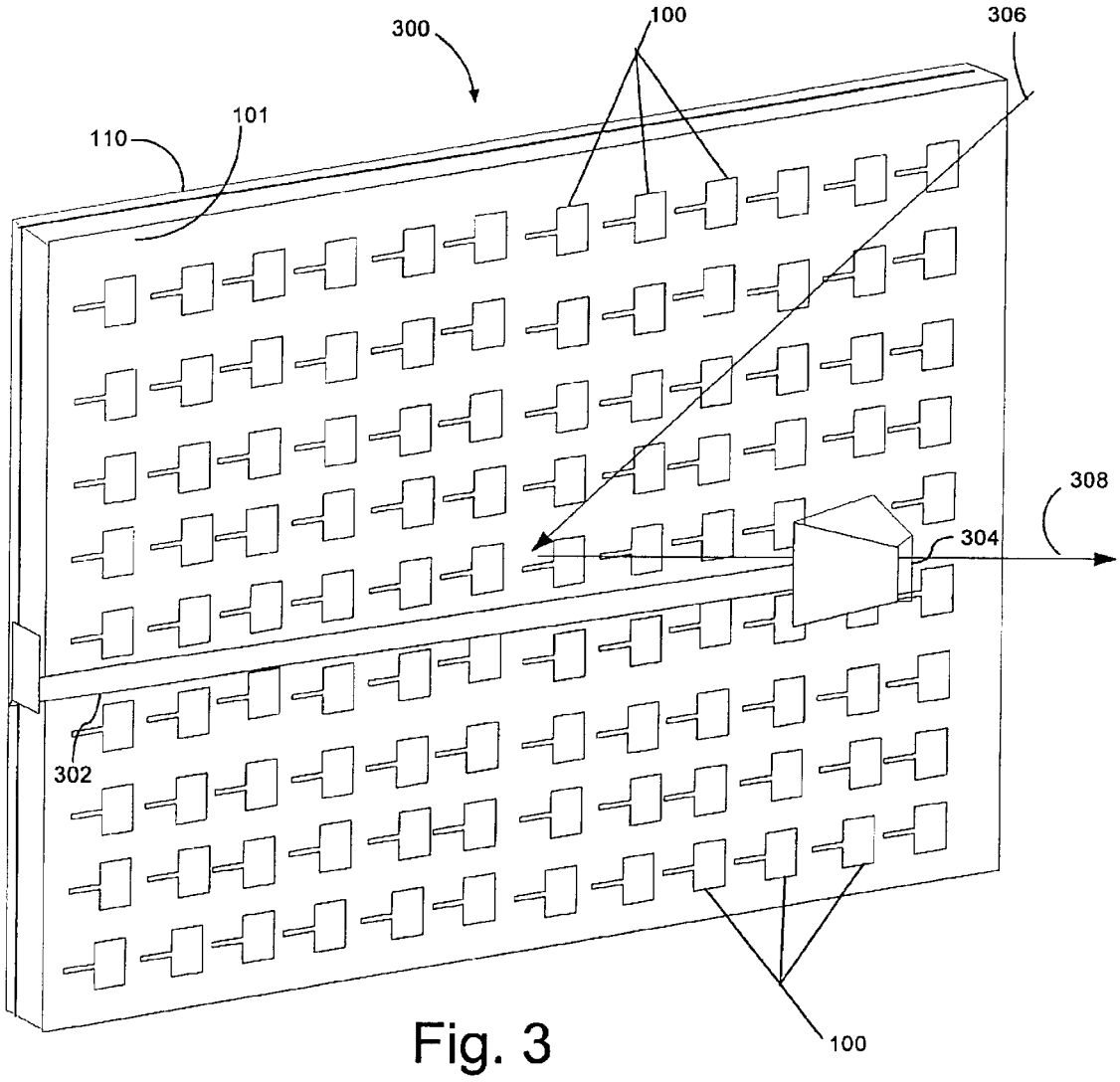
FIG. 3 is a perspective view of a periodic resonance structure incorporating the element of FIGS. 1 and 3.

Referring now to FIG. 3, there is shown a periodic resonance structure 300 which is formed as an array of elements 100, each including a transmission line stub 104 as described above. An electrical length of each transmission line stub 104 can be independently varied in the manner described above in response to commands from controller 122. A horn 304 can be provided on a suitable bracket 302 and can be configured for receiving RF, transmitting RF or both. FIG. 3 illustrates that an incident RF signal 306 which has some angle of arrival relative to the surface of substrate 101, can be redirected at a second angle to form a redirected beam 308. The precise mechanism by which the beam is redirected will be determined by the relative phase shift introduced to the incident signal by each element 100 of the array 300. Additional detail regarding such beam steering techniques are described in U.S. Pat. No. 4,684,952, the disclosure of which is expressly incorporated herein by reference.

Composition of the Fluidic Dielectric

The fluidic dielectric as described herein can be comprised of any fluid composition having the required characteristics of permittivity and permeability as may be necessary for achieving a selected range of phase shift. Those skilled in the art will recognize that one or more component parts can be mixed together to produce a desired permeability and permittivity required for a particular phase shift and transmission line characteristic impedance.

The fluidic dielectric 114 also preferably has a relatively low loss tangent to minimize the amount of RF energy lost in each element. However, devices with higher loss may be acceptable in some instances so this may not be a critical factor. Many applications also require a broadband response. Accordingly, it may be desirable in many instances to select fluidic dielectrics that have a relatively constant response over a broad range of frequencies.

Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the fluidic dielectric as described herein, it should be noted that the invention is not so limited. Instead, the composition of the fluidic dielectric could be formed in other ways. All such techniques will be understood to be included within the scope of the invention.

Those skilled in the art will recognize that a nominal value of permittivity ($\epsilon_r$) for fluids is approximately 2.0. However, the fluidic dielectric used herein can include fluids with higher values of permittivity. For example, the fluidic dielectric material could be selected to have a permittivity value of between 2.0 and about 58, depending upon the amount of phase shift required.

Similarly, the fluidic dielectric can have a wide range of permeability values. High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organometallic compounds, and other derivatives, although Fe and Co particles are most common. The size of the magnetic particles found in such systems is known to vary to some extent. However, particles sizes in the range of 1 nm to 20 μm are common. The composition of particles can be selected as necessary to achieve the required permeability in the final fluidic dielectric. Magnetic fluid compositions are typically between about 50% to 90% particles by weight. Increasing the number of particles will generally increase the permeability.

More particularly, a hydrocarbon dielectric oil such as Vacuum Pump Oil MSDS-12602 could be used to realize a low permittivity, low permeability fluid, low electrical loss fluid. A low permittivity, high permeability fluid may be realized by mixing same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivty.

Similar techniques could be used to produce fluidic dielectrics with higher permittivity. For example, fluid permittivty could be increased by adding high permittivity powders such as barium titanate manufactured by Ferro Corporation of Cleveland, Ohio. For broadband applications, the fluids would not have significant resonances over the frequency band of interest.

RF Unit Structure, Materials and Fabrication

According to one aspect of the invention, the dielectric substrate 101 can be formed from a ceramic material. For example, the dielectric structure can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention.

Beam Control Process

Figure 4:
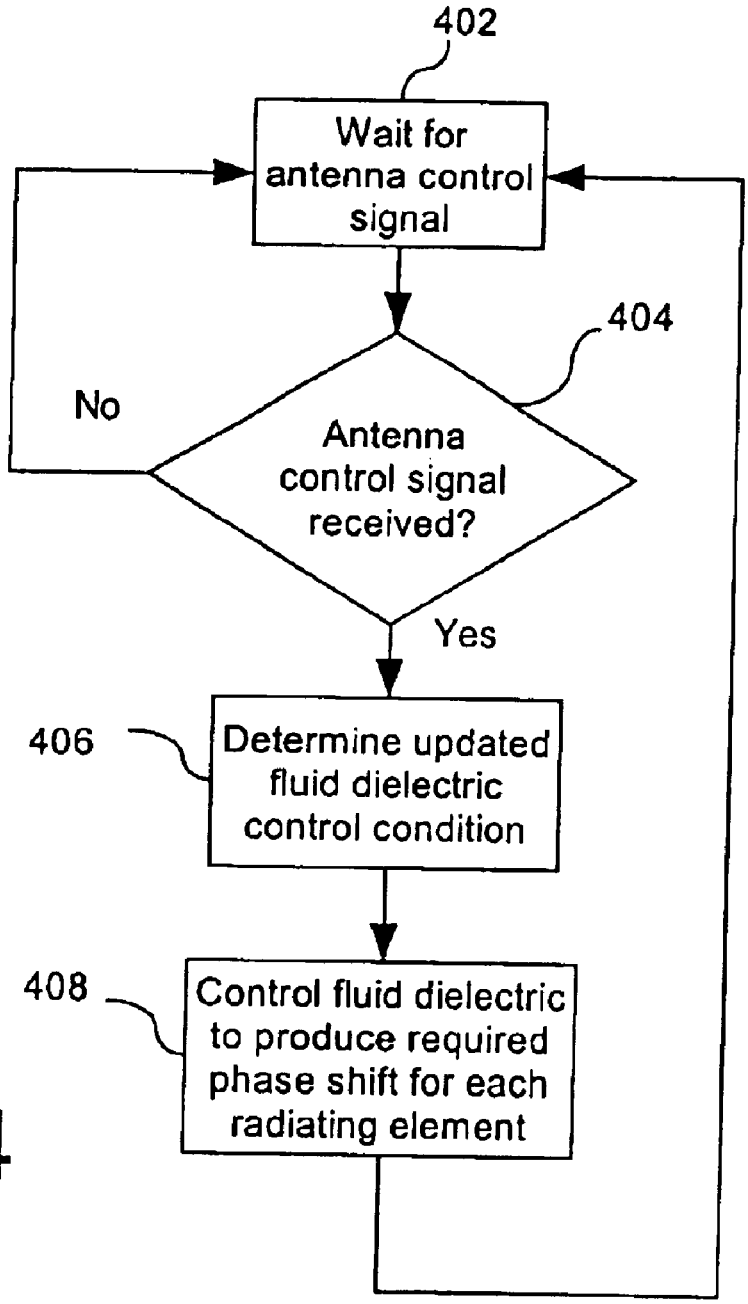
FIG. 4 is a flowchart that is useful for understanding a method for steering an antenna beam using a periodic resonance structure.

Referring now to FIG. 4, a process shall be described for controlling the angle of a redirected RF beam using the periodic resonance structure 300. In step 402 and 404, controller 122 can wait for an antenna control signal 137 indicating a requested angle for a redirected beam. Once this information has been received, the controller 122 can determine in step 406 a required phase shift for each transmission line stub 104 and a required amount of fluid dielectric 114 that is needed for each cavity structure 108 in order to produce the required phase shift. In step 408, the controller 122 can selectively control pumps 116 associated with each element 100 to produce the required phase shift.

As an alternative to calculating the required configuration of the fluid dielectric, the controller 122 could also make use of a look-up-table (LUT). The LUT can contain cross-reference information for determining control data for each element 100 necessary to achieve various redirected beam angles. For example, a calibration process could be used to identify the specific digital control signal values communicated from controller 122 to each of the pumps 116 that are necessary to achieve a specific angle for the redirected beam. These digital control signal values could then be stored in the LUT. Thereafter, when control signal 137 is updated, the controller 122 can immediately obtain the corresponding digital control signal for producing the required beam.

As an alternative, or in addition to the foregoing methods, the controller 122 could make use of an empirical approach that applies a reference signal to each radiating element and then measures the phase shift that occurs at each element 100. Specifically, the controller 122 can check to see whether the updated phase shift for each element has been achieved. A feedback loop could then be employed to control the pumps 116 to produce the desired redirected beam angle.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A method for steering an antenna beam using a periodic resonance structure, comprising the steps of:

electrically and magnetically coupling a first fluid dielectric to a plurality of transmission line stubs that are respectively coupled to a plurality of radiating elements of a periodic resonance structure; and controlling said first fluid dielectric to selectively vary an electrical length of said plurality of transmission line stubs, whereby an angle can be controlled for a redirected RF beam produced by an incident RF signal impinging on said periodic resonance structure.

2. The method according to claim 1 wherein said controlling step further comprises the step of varying a volume of said first fluid dielectric coupled to said transmission line stubs to control an electrical length of said plurality of transmission line stubs.

3. The method according to claim 2 wherein said step of selectively varying said volume includes pumping a fluid dielectric into and out of a cavity structure positioned adjacent to said transmission line stub.

4. The method according to claim 2 further comprising the step of independently varying said volume of said first fluid dielectric coupled to each of said plurality of transmission line stubs to control said angle of said redirected RF beam.

5. The method according to claim 2 wherein said step of varying said volume further comprises displacing with said first fluid dielectric a gas contained in said cavity structure.

6. The method according to claim 2 wherein said step of varying said volume further comprises displacing with said first fluid dielectric a second fluid dielectric also contained within said cavity structure.

7. The method according to claim 6 further comprising the step of selecting said first and second fluid dielectrics to be immiscible.

8. The method according to claim 1 wherein said step of selectively controlling said fluid dielectric further comprises controlling a presence or removal of a volume of said first fluid dielectric from a plurality of cavity structures respectively coupled to said plurality of transmission line stubs for controlling an electrical length of said plurality of transmission line stubs.

9. A steerable beam antenna comprising:

a periodic resonance structure comprising a plurality of transmission line stubs respectively coupled to a plurality of radiating elements;

a plurality of cavity structures each containing at least a first fluid dielectric, said first fluid dielectric electrically and magnetically coupled to said transmission line stubs; and at least one fluid processor controlling said fluid dielectric for selectively varying an electrical length of said transmission line stubs, whereby an angle of a redirected RF beam produced by an incident RF signal impinging on said periodic resonance structure can be controlled.

10. The steerable beam antenna according to claim 9 wherein said fluid processor comprises a controller and at least one pump for controlling a volume of said first fluid dielectric in said cavity structures to vary an electrical length of said plurality of transmission line stubs.

11. The steerable beam antenna according to claim 10 wherein said first fluid dielectric displaces a gas in said cavity structures.

12. The steerable beam antenna according to claim 10 wherein said first fluid dielectric displaces a second fluid dielectric in said cavity structure.

13. The steerable beam antenna according to claim 12 wherein said first and second fluid dielectrics are immiscible.

14. The steerable beam antenna according to claim 13 wherein an immiscible fluid interface separates the first and second fluid dielectrics.

15. The steerable beam antenna according to claim 9 wherein said fluid processor controls said first fluid dielectric by independently increasing and decreasing a volume of said first fluid dielectric contained in said plurality of cavity structures respectively coupled to said plurality of transmission line stubs.

16. The steerable beam antenna according to claim 9 wherein said periodic resonance structure is an array of patch antennas.

* * * * *